United States Patent [19]

Steiniger et al.

[11] Patent Number: 4,990,227

[45] Date of Patent: Feb. 5, 1991

[54] PREPARATION OF HYDROXYCARBOXYLIC ESTERS

[75] Inventors: Michael Steiniger, Neustadt; Heinz Hannebaum, Ludwigshafen, both of Fed. Rep. of Germany

[73] Assignee: BASF Aktiengesellschaft, Ludwigshafen, Fed. Rep. of Germany

[21] Appl. No.: 331,943

[22] Filed: Mar. 31, 1989

[30] Foreign Application Priority Data

Apr. 29, 1988 [DE] Fed. Rep. of Germany ..... 3814498

[51] Int. Cl.[5] ..... C25B 3/02

[52] U.S. Cl. ..... 204/59 R; 204/78; 204/79

[58] Field of Search ..... 204/78, 79, 80, 59 R

[56] References Cited

U.S. PATENT DOCUMENTS

| | | | |
|---|---|---|---|
| 4,402,804 | 9/1983 | Jackson | 204/78 |
| 4,640,750 | 2/1987 | Blickle | 204/79 |
| 4,702,803 | 10/1987 | Steiniger et al. | 204/78 |
| 4,820,389 | 4/1989 | Degner et al. | 204/78 |

OTHER PUBLICATIONS

Baizer et al., "Organic Electrochemistry an Introduction and a Guide", Second Edition, (1983), Marcel Dekker, Inc., New York, p. 183.

Acta Chem. Scand. 27, 3009 (1973).

J. Org.Chem. 53, 218–219 (1988).

J. Electrochem. Soc. 125, pp. 1401–1403 (1978).

J. Org. Chem., 50, 4967–4969 (1985), T. Shono et al.: "Electrooxidative Transformation of Aldehydes to Esters Using Mediators".

*Primary Examiner*—John F. Niebling

*Assistant Examiner*—Steven P. Marquis

*Attorney, Agent, or Firm*—John H. Shurtleff

[57] ABSTRACT

Hydroxycarboxylic esters of the general formula

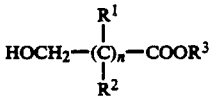

I where n is an integer from 0 to 10, $R^1$ and $R^2$ are each hydrogen, hydroxyl, alkoxy or an aliphatic or olefinic, straight-chain, branched or cyclic hydrocarbon radical, and $R^1$ and $R^2$ together may furthermore form an alkylene radical, and the hydrocarbon radicals may furthermore be substituted by halogen, hydroxyl, epoxy or nitrile, and $R^3$ is a low molecular weight alkyl radical, are prepared by electrochemical oxidation of a hydroxyaldehyde of the general formula

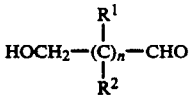

II in the presence of an alcohol of the formula $R^3OH$ and of an ionic bromide or chloride in an undivided electrolysis cell.

5 Claims, No Drawings

PREPARATION OF HYDROXYCARBOXYLIC ESTERS

The present invention relates to a novel process for the preparation of hydroxycarboxylic esters by electrochemical oxidation of hydroxyaldehydes.

Various processes for the single-stage conversion of aldehydes into carboxylic esters have been disclosed, but only a few of these are suitable for oxidizing aliphatic hydroxyaldehydes, with retention of the primary or secondary hydroxyl function, to hydroxycarboxylic esters in the presence of lower alcohols. For example, Acta Chem. Scand. 27 (1973), 3009 discloses that glycollaldehyde can be oxidized with silver carbonate on kieselguhr in methanol to give methyl glycollate. The use of the expensive silver as an oxidizing agent and the expensive regeneration necessary to avoid silver losses mean that this process is uneconomical for industrial use.

J. Org. Chem. 53 (1988), 218–219 describes a process in which 3-hydroxy-2,2-dimethylpropanal in methanol is electrochemically oxidized in the presence of potassium iodide and a strong base, such as sodium methylate, to methyl 3-hydroxypivalate. The disadvantage of this process is that the electrolysis is carried out in a divided electrolysis cell at platinum anodes. In comparison with undivided electrolysis cells, this means not only higher capital costs but also higher energy consumption, since there is a greater voltage drop at the separator (diaphragm) owing to the low conductivity of the organic electrolyte. Another disadvantage is that in this method, which requires the presence of sodium methylate, it is possible to oxidize only those aliphatic aldehydes which cannot undergo aldol condensation.

We have found that hydroxycarboxylic esters of the general formula

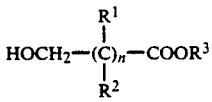

I where n is an integer from 1 to 10, $R^1$ and $R^2$ are each hydrogen, hydroxyl, alkoxy or an aliphatic or olefinic, straight-chain, branched or cyclic hydrocarbon radical, and $R^1$ and $R^2$ together may furthermore form an alkylene radical, and the hydrocarbon radicals may furthermore be substituted by halogen, hydroxyl, epoxy or nitrile, and $R^3$ is a low molecular weight alkyl radical, can particularly advantageously be prepared by electrochemical oxidation of a hydroxyaldehyde of the general formula

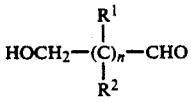

II in the presence of an alcohol of the formula $R^3OH$, where n, $R^1$, $R^2$ and $R^3$ have the abovementioned meanings, if the electrochemical oxidation is carried out in the presence of an ionic bromide or chloride in an undivided electrolysis cell.

The novel process gives the hydroxycarboxylic esters with high selectivity and high current efficiencies. This advantageous result is surprising since J. Electrochem. Soc. 125 (1978), 1401–1403 states that the electrochemical oxidation of the primary alcohols in undivided electrolysis cells at graphite electrodes in the presence of chloride and bromide ions leads to aldehydes. Accordingly, the reaction products of the novel process were expected to be ω, ω-dialkoxycarboxylic esters or dicarboxylic esters.

The result of the novel process was furthermore not obvious since J. Org. Chem. 53 (1988), 218 mentions that the electrochemical oxidation of the aldehydes does not take place in the presence of potassium bromide or potassium chloride but only gives satisfactory yields with iodides or iodine in the presence of sodium methylate in divided electrolysis cells.

In the hydroxyaldehydes of the formula II, n is from 0 to 10, preferably from 0 to 5. The aliphatic or olefinic straight-chain or branched hydrocarbon radicals $R^1$ and $R^2$ are, for example, alkyl or alkylene groups of 1 to 10, in particular 1 to 6, preferably 1 to 4, carbon atoms, such as methyl, ethyl, n-propyl, isopropyl, n-butyl, isobutyl or tert-butyl. Substituted hydrocarbon radicals of the stated type are, for example, hydroxymethyl, chloromethyl or hydroxyethyl. Cyclic hydrocarbons are, for example, cycloalkyl of 3 to 8, in particular 5 or 6, carbon atoms. The two radicals $R^1$ and $R^2$ together may furthermore form an alkylene radical, which, for example, may consist of from 2 to 5 methyl groups.

In the alcohols of the formula $R^3OH$, $R^3$ is a low molecular weight alkyl radical, in particular alkyl of 1 to 5 carbon atoms, preferably methyl or ethyl. For example, n-propanol, isopropanol, n-butanol, n-pentanol and, preferably, methanol or ethanol can be used. Suitable ionic halides are salts of hydrobromic acid and hydrochloric acid. Salts of hydrobromic acid, such as alkali metal bromides, alkaline earth metal bromides and quaternary ammonium bromides, in particular tetraalkylammonium bromides, are preferred. The cation is not important with regard to the invention; it is therefore also possible to use other ionic metal halides, but cheap halides are advantageously chosen. Examples are sodium bromide, potassium bromide, calcium bromide and ammonium bromide, as well as di-, tri- and tetramethyl- and tetraethylammonium bromide.

The novel process can be carried out in the conventional industrial electrolysis cells. It can advantageously be effected in an undivided flow-through cell which permits the electrode spacing to be kept very small in order to minimize the cell voltage. The preferred electrode spacings are 1 mm or less, in particular from 0.25 to 0.5 mm.

A preferred anode material is graphite. However, it is also possible to use other anode materials which are stable under the reaction conditions. The cathode material consists of, for example, metals such as lead, iron, steel, nickel or noble metals, e.g. platinum. Graphite is also a preferred cathode material.

The composition of the electrolyte can be varied within wide limits. For example, the electrolyte consists of from 1 to 80% by weight of a hydroxyaldehyde of the formula II, from 10 to 95% by weight of $R^3OH$ and from 0.1 to 10% by weight of a halide.

If desired, a solvent may be added to the electrolyte, for example for improving the solubility of the hydroxyaldehyde or of the halide. Examples of suitable solvents are nitriles, such as acetonitrile, and ethers, such as tetrahydrofuran. The solvents are added in amounts of, for example, not more than 30% by weight, based on the electrolyte. The current density is not a limiting factor for the novel process and is, for example, from 1 to 25, preferably from 3 to 12, A/dm$^2$. In the procedure under atmospheric pressure, the temperature of the electrolysis is advantageously chosen so that it is at least 5°-10° C. below the boiling point of the electrolyte. When methanol or ethanol is used, electrolysis is preferably carried out at from 20° to 30° C. We have found, surprisingly, that the novel process makes it possible substantially to convert the hydroxyaldehydes without causing reduced yields of hydroxycarboxylic esters, for .example as a result of secondary oxidation reactions. In the novel process, the current efficiencies are also unusually high. For example, the hydroxyaldehyde is already completely converted when electrolysis is carried out with from 2 to 2.5 F/mole of hydroxyaldehyde.

The electrolyzed mixtures can be worked up by a conventional method and are advantageously worked up by distillation. Excess alcohol and any cosolvent used are first distilled off. The halides are separated off in a known manner, for example by filtration or extraction, and the hydroxycarboxylic esters are purified by distillation or are recrystallized. The alkanol, any unconverted hydroxyaldehyde and the cosolvent and halides can advantageously be recycled to the electrolysis. The novel process can be carried out either batchwise or continuously.

The hydroxycarboxylic esters prepared by the novel process are versatile intermediates for the synthesis of crop protection agents or polymers.

EXAMPLES 1 TO 9

The electrochemical oxidation was carried out in an undivided electrolysis cell containing anodes and cathodes of graphite, at from 20° to 25° C. The composition of the electrolyte used and the electrolysis conditions are summarized in the Table. During the electrolysis, the electrolyte was pumped through the cell at a rate of 200 l/h, via a heat exchanger.

After the end of the electrolysis, the alcohol was distilled off under atmospheric pressure, and the remaining residue was purified by distillation under from 1 to 40 mbar. The hydroxycarboxylic esters were obtained in yields of from 54 to 81%, based on the starting material (II), at a conversion of >98%.

TABLE

| No. | Hydroxyaldehyde of the formula II $R^1$ | $R^2$ | Alkanol of the formula $R^3OH$ $R^3$ | Composition of the electrolyte II [% by wt.] | Halide | $R^3OH$ | Quantity of electricity (F/mol) | Current density (A/dm$^2$) | Voltage (V) | Conversion (%) | Yield (%) |
|---|---|---|---|---|---|---|---|---|---|---|---|
| 1 | $CH_3$ | $CH_3$ | $CH_3$ | 25 | 1 | 74 | 2.2 | 10 | 5.4 | 99 | 70 |
| 2 | $CH_3$ | $C_2H_5$ | $CH_3$ | 10 | 1 | 89 | 2.5 | 10 | 4.8 | 99 | 54 |
| 3 | $CH_3$ | $CH_2OCH_3$ | $CH_3$ | 10 | 1 | 89 | 2.5 | 10 | 5.0 | 100 | 81 |
| 4 | $CH_3$ | $CH_2OH$ | $CH_3$ | 24 | 1 | 75 | 2.5 | 10 | 6.6 | 98 | 62 |
| 5 | $-(CH_2)_5-$ | | $CH_3$ | 10 | 1 | 89 | 2.5 | 10 | 5.2 | 100 | 60 |
| 6 | $CH_3$ | $CH_3$ | $CH_3$ | 20 | 1 | 79 | 2.5 | 10 | 4.3 | 98 | 63 |
| 7 | H | H | $CH_3$ | 5 | 1 | 94 | 2.3 | 7.5 | 4.2 | 99 | 68 |
| 8 | H | H | $CH_3$ | 10 | 1 | 89 | 2.5 | 10 | 4.5 | 99 | 60 |
| 9 | $CH_3$ | $C_3H_7$ | 10 | 1 | 89 | 2.5 | 7.5 | 9.6 | 99 | 54 | |

Comment on Table:
In Example 6, the halide used was LiCl. In all other Examples, the halide used was NaBr. The yields stated in Examples 3 and 4 were determined by gas chromatography.

We claim:

1. A process for the preparation of a hydroxycarboxylic ester of the formula

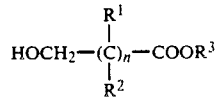

I where n is an integer from 0 to 10, $R^1$ and $R^2$ are each hydrogen, hydroxyl, alkoxy or an aliphatic or olefinic, straight-chain, branched or cyclic hydrocarbon radical, and $R^1$ and $R^2$ together may furthermore form an alkylene radical, and the hydrocarbon radicals may furthermore be substituted by halogen, hydroxyl, epoxy or nitrile, and $R^3$ is a low molecular weight alkyl radical, by electrochemical oxidation of a hydroxyaldehyde of the formula

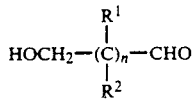

II in the presence of an alcohol of the formula $R^3OH$, where n, $R^1$, $R^2$ and $R^3$ have the abovementioned meanings, wherein the electrochemical oxidation is carried out in the presence of an ionic bromide or chloride in an undivided electrolysis cell.

2. A process as claimed in claim 1, wherein the ionic bromide used is an alkali metal or alkaline earth metal bromide or a quaternary ammonium bromide.

3. A process as claimed in claim 1, wherein the electrochemical oxidation is carried out at graphite anodes.

4. A process as claimed in claim 1, wherein methanol or ethanol is used as the alcohol of the formula $R^3OH$.

5. A process as claimed in claim 1, wherein the electrochemical oxidation is carried out at a current density of from 1 to 25 A/dm$^2$.

* * * * *